United States Patent [19]

Bosch et al.

[11] Patent Number: 4,857,805

[45] Date of Patent: Aug. 15, 1989

[54] PICTURE DISPLAY DEVICE WITH STRAY FIELD COMPENSATION MEANS

[75] Inventors: Gerrit Bosch; Tjebbe R. Pasma; Albertus A. S. Sluyterman; Fransiscus M. P. P. Doomernik; Steven M. Wielink, all of Eindhoven, Netherlands

[73] Assignee: U.S. Philips Corporation, New York, N.Y.

[21] Appl. No.: 187,614

[22] Filed: Apr. 28, 1988

[30] Foreign Application Priority Data

May 11, 1987 [NL] Netherlands ..... 8701109

[51] Int. Cl.[4] ..... H01F 13/00; H01J 31/20

[52] U.S. Cl. ..... 315/8; 315/370; 315/371; 315/85; 313/440

[58] Field of Search ..... 315/8, 85, 370, 371; 373/440

[56] References Cited

U.S. PATENT DOCUMENTS 2,994,803 8/1961 Goldberg ..... 315/8
3,879,633 4/1975 Stark, Jr. ..... 315/8
4,634,930 1/1987 Toshiyasu et al. ..... 315/8
4,700,114 10/1987 Southerland, II ..... 315/8

FOREIGN PATENT DOCUMENTS 220777 10/1985 Netherlands ..... 315/8

*Primary Examiner*—Donald J. Yusko
*Assistant Examiner*—Brian S. Palladino

[57] ABSTRACT

Picture display device having a display tube and a deflection unit (9) comprising a field deflection coil and a line deflection coil (11). In order to comply with a predetermined interference radiation standard, the picture display device is provided with a compensation coil system having a first set of compensation coils (18, 19) for generating a dipole compensation field and possibly a second set of compensation coils (**18*a*, 19*a*) for generating a fourpole compensation field, the compensation coil system being preferably arranged in series with the line deflection coil 11 ) and being provided with electric means (R**; $R_1$; $R_2$; $R_3$; $R_4$) to shift the phase of the current through at least a part of the compensation coil system with respect to the phase of the current through the line deflection coil.

12 Claims, 4 Drawing Sheets

PICTURE DISPLAY DEVICE WITH STRAY FIELD COMPENSATION MEANS

BACKGROUND OF THE INVENTION

The invention relates to a picture display device having a display tube with a device for generating electron beams at the rear and a phosphor screen at the front, an electromagnetic deflection unit mounted around part of the display tube for deflecting electron beams across the display screen includes a line deflection coil and a field deflection coil. A compensation coil system having at least one compensation coil for generating a magnetic dipole field, is oriented in such manner and in operation in energisable in such manner that, measured at a predetermined distance from the operative display device, the magnetic (interference) field generated by the line deflection coil is at least partly compensated.

A picture display device of this type having means for compensating (line deflection coil) stray fields is known from EP-A No. 220777.

Recently more stringent standards have been introduced for certain types of picture display devices, notably for monitors, with respect to the magnetic interference field which they may produce around them. An important source of magnetic interference fields is the line deflection coil because it is operated at radio frequency currents (frequencies in the range of 10 to 10 kHz) as contrasted to the field deflection coil. It is impossible to design a satisfactory operating deflection coil that produces no stray field. If the stray field were to be eliminated by means of a protective shield, such a shield would only be effective if the combination of display tube and deflection unit were also shielded on the display screen side. The abovecited patent application describes the use of a compensation coil system for eliminating the line deflection stray field at a larger distance, which system, when energized, generates a compensating magnetic dipole field. This dipole field can be obtained by energising one coil whose turns are mainly in one flat plane (a current loop), which coil has the correct number of turns, the correct surface area and the correct orientation. The fact that the spatial position of the compensating dipole moment deviates from that of the deflection unit (which is positioned more to the front) makes little difference at a larger distance (>3 m). Energising can be effected by arranging the compensation coil in series with or parallel to the line deflecting coil. This dipole field can be obtained in an alternative manner by energising two current loops which are positioned on the outside of the line deflection coil with two main portions of their length extending at least approximately parallel to the tube axis on facing sides thereof, which current loops have the correct number of turns, the correct surface area and the correct orientation. Energising may also be effected by arranging the compenstion coils formed by the current loops in series with or parallel to the line deflection coil. For a compensation at smaller distances (for example, 0.5 m from the deflection unit) it is desirable to generate a compensating fourpole field with the compensation coil system. This fourpole field can be generated, for example, by means of two coils or coil portions which are positioned symmetrically relative to the plane of symmetry of the line deflection coils and perpendicularly to the tube axis.

It has been calculated that the radiation field of a line deflection coil at a distance of 0.5 m can be suppressed, for example, by a factor of 20 with a compensation coil system generating a dipole-fourpole field, thus just complying with the current requirements.

It has been found that a compensation coil system dimensioned and energised in order to realise the above-described effect often suppressed the radiation field by not more than a factor of 10, that is to say, only a partial compensation occurred after the system had been placed on a combination of display tube and deflection coil.

SUMMARY OF THE INVENTION

The object of the invention is to provide measures which ensure a more complete compensation of the radiation field of the line deflection coil.

A compensation coil system which is electrically connected (in series with or parallel to) the line deflection coil, and electric means shift the phase of the current through the compensation coil with respect to the phase of the current through the line deflection coil.

The invention is based on the recognition that metal parts are present in a display tube. These may be both plate-shaped parts such as protective shields and layer-shaped parts such as a layer of an electrically conducting material (for example, Al) provided across the phosphor screen on the inside of the display tube. The field which is not yet compensated at the area of the said metal parts produces eddy currents therein which generate a secondary magnetic field. This secondary field is (90 degrees) out of phase with the primary field and at 0.5 m from the deflection unit it is approximately equally strong as the compensated field. The measures according to the invention ensure that a current component flows through at least a part of the compensation coil system which is also (90 degrees) out of phase with the component flowing through the line deflection coil. This ensures a more complete compensation. Phase shift can be realised, for example, by arranging an electric resistor in parallel. If the compensation coils not only have a self-induction but also a significant resistivity, it is useful to arrange a capacitor in series with the parallel resistor. This results in the 90° shifted component being realised over a larger frequency range.

For display tubes having a homogeneous aluminium coating of the phosphor screen it appears that a reduction factor of 20 can indeed be realized. However, in some types of display tubes the Al layer does not provide a homogeneous coating. The parallel arrangement of one single resistor with the compensation coil system does not appear to lead to quite the desired result. The same may occur if other metal parts in the display tube such as the protective shield, have an asymmetrical surface area. In order to achieve a compensation which is also as complete as possible in these situations, it is advantageous if the compensation coil system has a plurality of (series-arranged) compensation coils, whilst at least one compensation coil constitutes a parallel arrangement with an electric resistor.

When using the above-described measure it is possible to ensure a compensation which is as complete as possible, dependent on the specific geometry of the interfering asymmetrical metal parts in the display tube, by providing one or more parallel resistors between different points of the series-arranged compensation coils. If the monitor instead of the tube has many conducting elements, it may be useful to arrange a resistor (possibly with a capacitor) in parallel with the deflection coil. The compensation coil system may be composed in different manners. It may comprise a first set of two compensation coils for generating a dipole compensation field, which coils are positioned symmetrically with respect to the plane of symmetry of the line deflection coil and extend with main portions of their lengths in the axial direction (and are preferably connected in a series arrangement). To provide the possibility of compensation at smaller distances, the compensation coil system may further comprise a second set of two compensation coils for generating a fourpole compensation field, which coils are positioned symmetrically with respect to the plane of symmetry of the line deflection coil and extend with main portions of their lengths transversely to the axial direction (and are preferably connected in a series arrangement).

Dependent on the effect which is to be achieved, the compensation coils of the first and second sets which are positioned on the same side of the plane of symmetry of the line deflection coil may be connected in series and constitute a parallel arrangement with one electric resistor, or the compensation coils of the first and second sets which are positioned on different sides of the plane of symmetry of the line deflection coil may constitute a parallel arrangement with one electric resistor.

The compensation coils are preferably large in order to reduce their energy content.

However, a problem is that many types of display devices (particularly monitors) lack the space to accommodate large coil systems in their correct positions. Consequently, relatively small (too small) compensation coils must be used so that the radiation compensation consumes much (line deflection) energy. The space available for the coils extending with main portions of their lengths transversely to the axial direction is particularly insufficient if they have to be placed closer to the display screen.

In a further embodiment of the picture display device according to the invention this problem is mitigated in that the compensation coils of the first and/or the second set each comprise at least two subcoils placed parallel to each other at a predetermined distance. The effect thereof will be described hereinafter.

DETAILED DESCRIPTION OF THE PREFERRED EMBODIMENTS

Figure 1A:
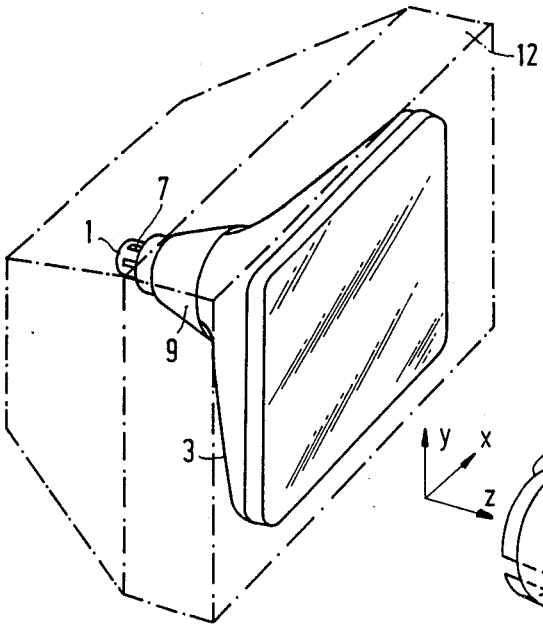
FIG. 1*a* is a perspective elevational view of a picture display device having a display tube provided with an electromagnetic deflection unit.

FIG. 1*a* shows a deflection unit and a display tube placed in a cabinet 12 which according to the invention can be provided with means for compensating interference fields. For the sake of clarity all details which are unimportant for understanding the invention have been omitted.

The display tube has a cylindrical neck 1 and a funnel-shaped portion 3, the widest part of which is present on the front side of the tube and comprises a display screen (not shown).

Figure 1B:
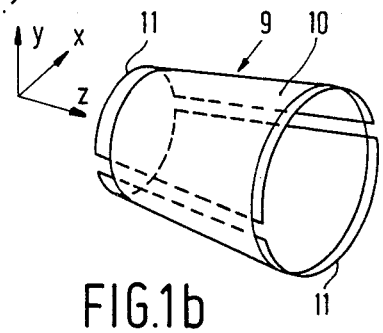
FIG. 1*b* shows diagramatically an electromagnetic deflection unit with a line deflection coil.

The display screen has phosphors which upon impingement by electrons luminesce in a predetermined colour. The rear part of the neck 1 accommodates an electron gun system 7 (shown diagrammatically). At the area of transition between the neck 1 and the funnel-shaped portion 3 an electromagnetic deflection unit 9 diagrammatically shown is provided on the tube, which unit comprises, inter alia, a line deflection coil 11 (FIG. 1*b*) for deflecting the electron beams in the horizontal direction x. As is diagrammatically shown in FIG. 1*b*, the line deflection coil 11 may comprise two saddle-shaped coil halves which are positioned on either side of a plane of symmetry (the x-z plane). In the operating condition a sawtooth current having a frequency of between 10 and 100 kHz, for example, a frequency of approximately 64 kHz is passed through these coils. Generally the line deflection coil 11 is surrounded by an annular core element 10 of a soft magnetic material, the so-called yoke ring which is also shown diagrammatically in FIG. 1*b*.

When the radiation field of a line deflection coil having a yoke ring is initially equally large but opposed to that of a coil without a yoke ring, the line deflection coil can be assumed for large distances to be a current loop having a given magnetic moment.

The field $B_o$ in the centre of a line deflection coil without a yoke ring can be calculated to be approximately 30 Gauss. The field of a practical deflection coil having a yoke ring has approximately twice this value.

The line deflection coil field at 1 m distance is approximately 1 mGauss.

This radiation field can be compensated with the aid of an auxiliary loop current having a low nI value and a large radius such that the magnetic moment is the same as that of the coil itself. Such an auxiliary loop current can be generated by means of a compensation loop having a radius $R_c=20$ cm and a number of turns $n_c=4$. Thus a reduction of 40 dB can be realised at, for example, a distance of 3 m and more from the radiation source. The orientation of the compensation loop is to be such that the magnetic dipole moment generated upon current passage through this coil at a predetermined distance (for example 3 m) compensates the magnetic dipole moment of the interfering component. To this end the dipole moment of the compensation loop should be parallel to and oppositely directed relative to the dipole moment of the interfering component. The interfering component is the line deflection coil in the first place. Also the line output transformer may generate, for example, an interference field and can then be considered as an interfering component. In that case it applies that:

Parallel dipole moments originating from one or more components can be compensated with one current loop. Non-parallel dipole moments can be compensated with one loop when the frequency and the phase of the dipole moment to be compensated are the same.

Figure 1C:
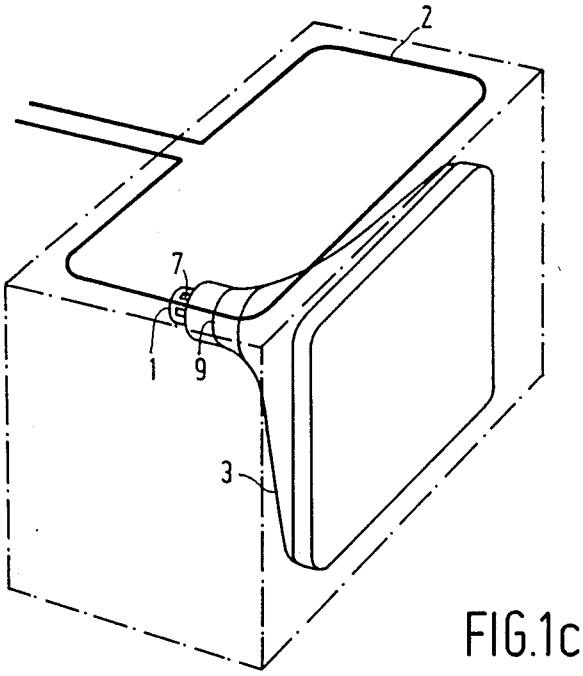
FIG. 1*c* is a perspective view of a picture display device having a display tube provided with an electromagnetic deflection unit, and a compensation coil.

Thus it is possible to compensate the magnetic stray fields of a device, comprising a plurality of directly interfering sources (line output stage, deflection coil) and a plurality of indirect sources ("reflectors", baseplates) with the aid of a compensation loop having a limited number of turns and a given diameter. Such a loop (compensation coil) is denoted by the reference numeral 2 in FIG. 1*c*.

By choosing the number of turns to be low and the surface area to be large, the following conditions can generally be satisfied:

1. the magnetic dipole moment vector is equal to the sum of the dipole moments of all direct sources in the device.
2. The load on the supply and the interference on the components in the device itself (notably the deflection coil) is sufficiently small.

Figure 2:
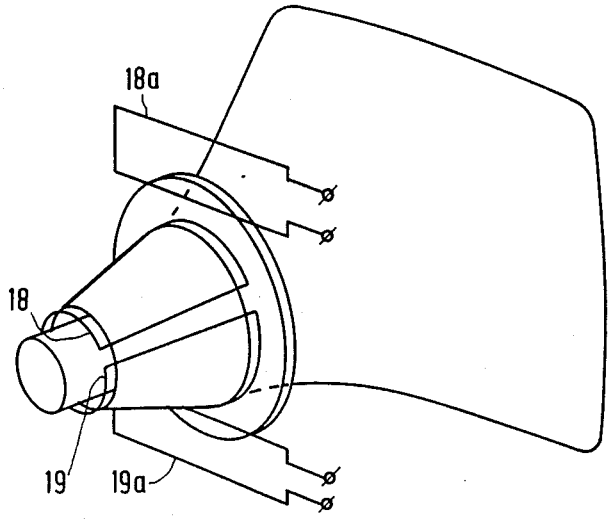
FIG. 2 is a perspective rear view of a display tube on which two sets of compensation coils are provided.

FIG. 2 shows a deflection unit with two sets of compensation coils, a first set 18, 19 extending with main portions of their lengths in the axial direction for generating a dipole compensation field and a second set 18a, 19a extending with main portions of their lengths tranversely to the axial direction for generating a fourpole compensation field. By correctly choosing the number of turns of the first set 18, 19 and of the second set 182, 192 and by correctly choosing both the current directions and the dimensions of the first and second sets, a considerable field reduction can be realised at distances of approximately 50 cm. As regards the correct choice of the current directions this notably implies that upon energisation of the compensation coil system the currents in the first parts flow in the same direction as the currents in the corresponding (axial) parts of the line deflection coil and the currents in the second parts flow in a direction which is opposed to the direction of the corresponding (transversal) parts of the line deflection coil.

Figure 3:
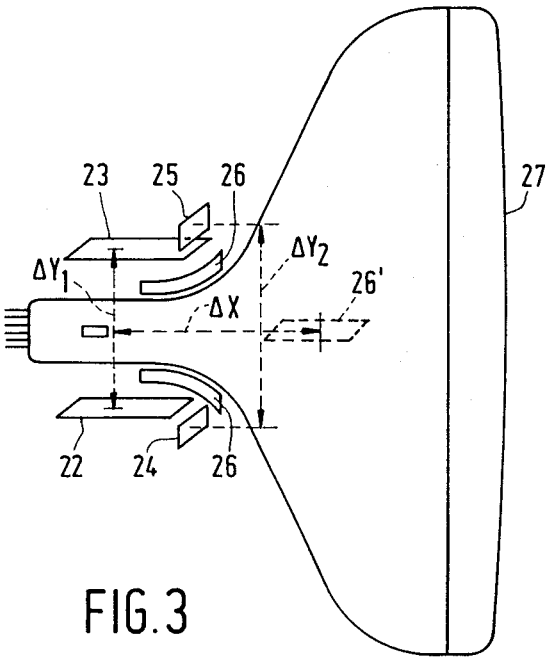
FIG. 3 shows diagrammatically a coil-tube combination in a longitudinal cross-section with two sets of compensation coils.

The operation of the coil arrangement of FIG. 2 is elucidated with reference to FIG. 3. The interfering field of a line deflection coil 26 may be roughly considered to be a dipole in the tube 27 (=coil 26'). The compensation is effected with the coils 22 and 23 which are provided symmetrically relative to the plane of symmetry of the line deflection coil 26. However, due to the distance $\Delta Y_1$ between the coils 22 and 23 a 6-pole component is produced, and a 4-pole component is produced due to the distance $\Delta X$. If the first set of compensation coils 22, 23 are moved forwards (in order to reduce $\Delta X$ and hence the 4-pole), $\Delta Y_1$ increases and so does the 6-pole. Therefore $\Delta Y_1$ remains small; the 6-pole can be slightly reduced by enlarging the diameter of the coils 22 and 23, which, however, results in that $\Delta X$ must increase because the coils cannot project into the tube. Mainly a 4-pole field proportional to the size of the coils, the current through the coils and the distance $\Delta Y_2$ is generated with the second set of compensation coils 24 and 25. A good combination of coil sizes and current intensities can neutralize the 4 and 6-poles. For the 8-poles it applies that all coils should not become so large that they are tangent to the measuring circle because then the 8-poles and even higher harmonics start playing a role.

Figure 4:
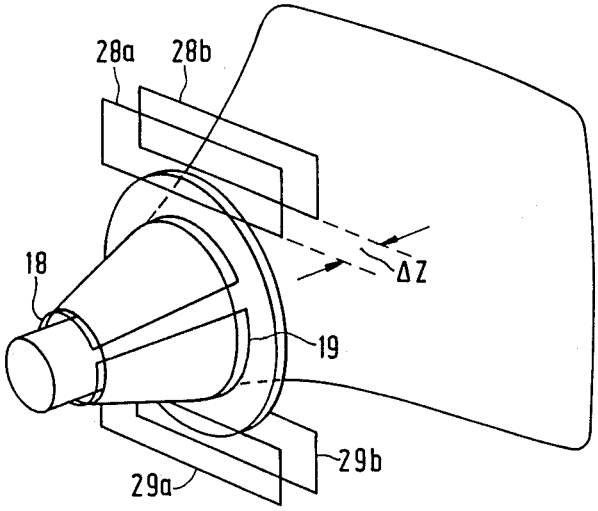
FIG. 4 is a perspective rear view of a display tube with one set of single and one set of double compensation coils.

As already noted it is important for the compensation coils to be large in connection with their energy consumption. This is a problem, particularly with the coils of the second set. They can each be built up from at least two sub-coils (28*a*, 28*b* and 29*a* and 29*b*, respectively in FIG. 4). By placing the sub-coils of each pair at a predetermined distance ($\Delta Z$) from each other, it can be ensured that the mutual inductance is minimum. In the case of two sub-coils each sub-coil pair may have half the number of turns which would otherwise be required for a single coil. This means that the inductance of the system with two pairs of sub-coils may be half the inductance of a system of single coils. This results in a reduction of the energy content.

Figure 5:
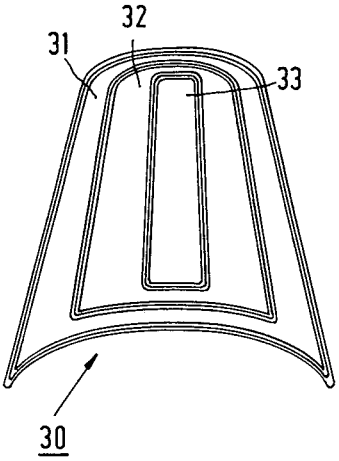
FIG. 5 is a diagrammatic plan view of a compensation coil half with three windows.

The saddle coils 18, 19 may be either of the self-supporting or of the co-salled yoke winding type. This means that they are directly wound on a support. This support may have, for example, two grooved flanges which are secured to the front and rear sides of the deflection unit. The positions of the axially extending turn portions can be fixed by means of the grooves. For use in different deflection units, for example, universal flanges (with grooves uniformly distributed over the circumference) can be used to wind compensation coils with two or more coil windows of different sizes. In this way the "effective" compensation coil surface can be adapted to each line deflection coil with which the compensation coil is combined. FIG. 5 is a diagrammatic plan view of a compensation saddle coil half 30 with three coil windows 31, 32 and 33 of different size.

As already described the magnetic stray field of a deflection coil can be compensated by means of a system of compensation coils. A simple dipole correction is sufficient for the compensation at a large distance (for example 3 m). It is desirable to add a fourpole correction for compensation at small distances (for example, 0.5 m from the deflection coil). In both cases the required extra energy is greatly determined by the geometrical dimensions of the coils; the larger the coils; the smaller the required energy. With such a dipole-fourpole combination, the radiation field at 0.5 m can be suppressed by a factor of 20, just complying with the current requirements.

If the coil thus compensated is placed on a display tube whose inner side has an aluminium coating for the purpose of picture brightness, then it appears that the - at the area of this layer not yet compensated - field produces eddy currents which generate a magnetic secondary field. (Such eddy currents may also be produced in other plate-shaped metal parts such as protective shields in a display tube). This secondary field is 90° (with respect to time) out of phase with the primary field and at 0.5 m from the deflection coil it is approximately as strong as the compensated field. This means that the reduction factor of 20 is reduced by approximately 50% so that the official standard is no longer complied with.

Figure 6:
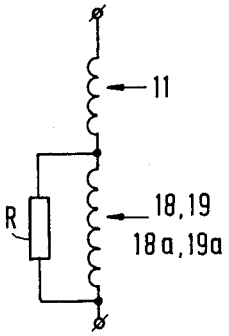
FIG. 6, 6A, 8, 9 and 10 shows (parts of) circuit arrangements for connecting compensation coils within the scope of the invention.
Figure 6A:
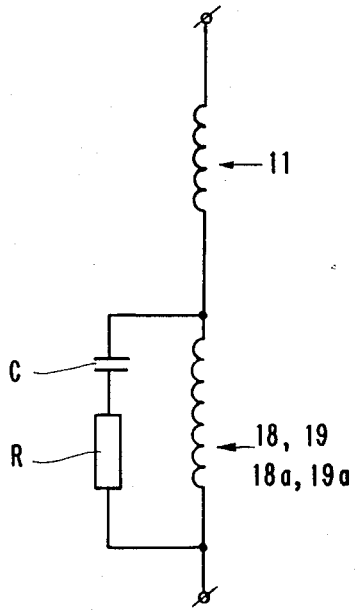

A solution has been found by arranging a resistor R in parallel with the compensation coils 18, 19, 19*a*, 19*b*, arranged on series with the deflection coil 11, see FIG. 6. The current through this resistor R is 90 degrees out of phase with the current flowing through the compensation coils so that in a current component flows through the compenstion coils which is also 90 degrees out of phase with the current flowing through the deflection coil 11. The compensation is corrected thereby. In a given case R complied with, for example, 300 Ohm. FIG. 6A shows a capacitor C in series with the resistor R, which is useful when the compensation coils have a significant resistivity in addition to self-induction.

For the display tubes having a homogeneous aluminium coating the reduction factor of 20 can thus be restored again. In some types of picture tubes, however, the Al layer does not appear as a homogeneous coating so that the above-mentioned solution provides only a partial correction.

Figure 7:
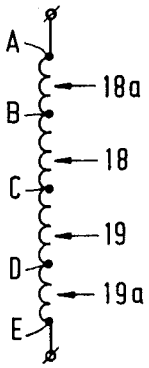

In order to restore the compensation for these situations as well, the compensation coil system can be formed in such a manner that the dipole coil and the (possibly present) fourpole coil each comprise two symmetrical parts (18, 19 and 18*a*, 19*a*, see FIG. 7) which have connection points A, B, C, D and E. Coils 18 and 18*a* and 19 and 19*a* are those halves of the dipole coil and the fourpole coil which are positioned on the same side of the plane of symmetry of the deflection coil 11.

Figure 8:
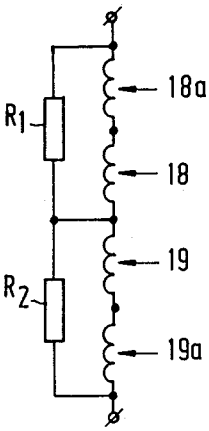
Figure 9:
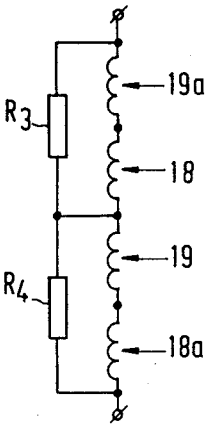

Dependent on the specific geometry of the interfering asymmetrical conductors in the display tube, the compensation can now be restored by providing one or more parallel resistors $R_1$, $R_2$ between different points of the circuit, see, for example FIG. 8. Alternatively the coils 18*a* and 19*a* can be electrically interchanged (geometrically they keep their position) and then one or more resistors $R_3$, $R_4$ can be provided, see FIG. 9. In a given case a value of 150 Ohm each for $R_1$, $R_2$, $R_3$ and $R_4$ was sufficient.

Figure 10:
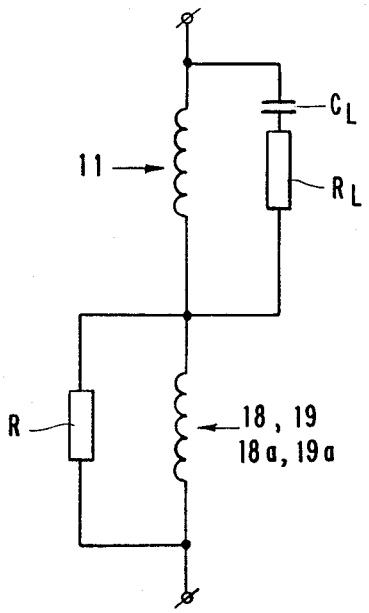

When the picture display device is a monitor having many conducting elements, it may be useful to arrange a resistor $R_1$ in parallel with the line deflection coil. This is shown in series with an optional capacitor $C_1$ in FIG. 10.

What is claimed is:

1. A picture display device having a display tube the rear part of which comprises a cylindrical neck accommodating a device for generating electron beams, whilst the front part is funnel-shaped, the widest part being provided on the front side and comprising a display phosphor screen, said display device also being provided with an electromagnetic deflection unit mounted around part of the display tube for deflecting electron beams across the display screen and comprising a line deflection coil and a field deflection coil, and with a compensation coil system comprising at least one compensation coil for generating at least a magnetic dipole field, which compensation coil system is oriented in such manner and in operation is energisable in such manner that, measured at a predetermined distance from the operative display device, the magnetic field generated by the line deflection coil is at least partly compensated, characterized in that the compensation coil system is electrically connected to the line deflection coil and is provided with means to shift the phase of the current through the compensation coil with respect to the phase of the current through the line deflection coil.

2. A picture display device as claimed in claim 1, characterized in that the compensation coil system comprises a plurality of series-arranged compensation coils and an electric resistor, at least one compensation coil being in parallel with said electric resistor.

3. A picture display device as claimed in claim 2, characterized in that at least two compensation coils are in a parallel with said electric resistor.

4. A picture display device as claimed in claim 2, characterized in that the compensation coil system comprises a first set of two compensation coils for generating a dipole compensation field, which coils are positioned symmetrically with respect to the plane of symmetry of the line deflection coil and extend with main portions of their lengths in the axial direction.

5. A picture display device as claimed in claim 4, characterized in that the compensation coil system also comprises a second set of two compensation coils for generating a fourpole compensation field, which coils are positioned symmetrically with respect to the plane of symmetry of the line deflection coil and extend with main portions of their lengths transversely to the axial direction.

6. A picture display device as claimed in claim 5, characterized in that the compensation coils of the first and second sets which are positioned on the same side of the plane of symmetry of the line deflection coil are connected in series and constitute a parallel arrangement with one electric resistor.

7. A picture display device as claimed in claim 5, characterized in that the compensation coils of the first and second sets which are positioned on different sides of the plane of symmetry of the line deflection coil are connected in series and are in a parallel with one electric resistor.

8. A picture display device as claimed in claim 4, characterized in that the two compensation coils of the first set each comprise at least two sub-coils placed parallel to each other at a predetermined distance.

9. A picture display device as claimed in claim 2, characterized in that a capacitor is arranged in series with the resistor.

10. A picture display device as claimed in claim 1, characterized in that a resistor, is arranged parallel to the line deflection coil.

11. A picture display device as in claim 10 further comprising a capacitor in series with said resistor, said capacitor and said resistor being arranged in parallel to the line deflection coil.

12. A picture display device as in claim 5 wherein the two compensation coils of the second set each comprise at least two sub-coils placed parallel to each other at a predetermined distance.

* * * * *